US011076667B2

(12) United States Patent
McCarthy

(10) Patent No.: US 11,076,667 B2
(45) Date of Patent: Aug. 3, 2021

(54) BACKPACK WITH MAGNETIC BACK-PANEL

(71) Applicant: Michael Joseph McCarthy, McAllen, TX (US)

(72) Inventor: Michael Joseph McCarthy, McAllen, TX (US)

( * ) Notice: Subject to any disclaimer, the term of this patent is extended or adjusted under 35 U.S.C. 154(b) by 20 days.

(21) Appl. No.: 16/840,096

(22) Filed: Apr. 3, 2020

(65) Prior Publication Data

US 2020/0367627 A1 Nov. 26, 2020

Related U.S. Application Data

(60) Provisional application No. 62/850,486, filed on May 20, 2019.

(51) Int. Cl.

| | |
|---|---|
| ***A45C 13/02*** | (2006.01) |
| ***A45C 13/10*** | (2006.01) |
| *A45C 11/00* | (2006.01) |
| *A45F 3/04* | (2006.01) |

(52) U.S. Cl.

CPC ..... *A45C 13/1069* (2013.01); *A45C 13/02* (2013.01); *A45C 2011/002* (2013.01); *A45F 3/04* (2013.01)

(58) Field of Classification Search

CPC ..... A45C 13/1069; A45C 13/02; A45C 2011/002; A45C 2003/007; A45C 11/24; A45F 3/04; A45F 4/02

See application file for complete search history.

(56) References Cited

U.S. PATENT DOCUMENTS

| | | | | |
|---|---|---|---|---|
| 6,336,555 | B1 * | 1/2002 | Breeden | A45C 11/24 206/214 |
| 9,936,782 | B2 * | 4/2018 | Puopolo | A45C 11/24 |
| 2005/0139558 | A1 * | 6/2005 | Kephart | A47G 29/08 211/13.1 |
| 2006/0027613 | A1 * | 2/2006 | Chang | A45F 3/12 224/183 |
| 2020/0170389 | A1 * | 6/2020 | Uriarte | A45F 3/047 |
| 2020/0187629 | A1 * | 6/2020 | Sniffen | A45C 7/0086 |
| 2020/0359851 | A1 * | 11/2020 | Lucero, III | A47C 31/113 |
| 2021/0145140 | A1 * | 5/2021 | Plata | E05B 73/00 |

* cited by examiner

*Primary Examiner* — Corey N Skurdal

(74) *Attorney, Agent, or Firm* — My Patent Guys; Christopher Pilling; Johan Eide

(57) ABSTRACT

A backpack with magnetic back-panel is provided and configured to enable a user to store their valuable and fragile belongings in the backpack and use the magnetic back-panel to securely store the backpack against any metal structure. Through the easily accessible magnetic back panel, the backpack securely connects to most of, if not all, metal surfaces. With this magnetic feature, the backpack can be positioned vertically or horizontally on metal structures to give the user a plethora of options to position at their desired setting. These options provide an environment that reduces the chance of damage and theft to the backpack, while making completely accessible to the user and removing health and injury concerns.

12 Claims, 7 Drawing Sheets

BACKPACK WITH MAGNETIC BACK-PANEL

CROSS-REFERENCE TO RELATED APPLICATIONS

The present invention claims priority to provisional application Ser. No. 62/850,486, filed May 20, 2019 which is hereby incorporated in its entirety at least by reference.

BACKGROUND OF THE INVENTION

1. Field of the Invention

The invention generally relates backpacks, and more particularly to a backpack with a magnetic back-panel.

2. Description of Related Art

Tens of millions of Americans carry a backpack daily. Once at their destination, wearers remove the backpack and, suddenly, need a place to safety and securely store it while still ensuring it's within reach. In many cases, there are designated areas such as lockers, closets, shelves, and hooks to store backpacks. However, these are not without their disadvantages. Lockers reduce the likelihood of theft, but limit the immediate accessibility of a backpack. Closets, hooks, and shelves are typically located away from foot traffic, lowering the chance of damage but increasing the risk of theft as these areas are typically neither secured nor supervised. These designated areas can be useful but also inefficient. To avoid these accessibility challenges and other inefficiencies, users often create their own solution and, often, that means storing bags on the floor. This is very common in gyms. For example, as people move to each workout station, they place their backpack on the floor next to each workout station. However, there are many disadvantages of storing the backpack on the floor which will be discussed herein. Consequently, there is a need for a solution in this field.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

It is an object of the present invention to overcome the backpack storage disadvantages of the prior art by providing a user with the ability to carry and store their backpack at their location, off the floor, on any metal structure available, most commonly in gyms.

In order to do so, a backpack is provided, comprising at least one storage compartment having an inner storage volume, wherein the at least one storage compartment is accessible via a first fastening system; a pair of shoulder straps configured to enable a user to carry the backpack; a back-panel; and, at least one magnet positioned in the back-panel, such that the backpack may magnetically attach to a magnetic surface.

In one embodiment, the back-panel includes a front portion and a rear portion, the rear portion having a centrally positioned vertical spine splitting the rear portion include a left side rear back-panel and a right-side rear back-panel. In one embodiment, the front portion of the back-panel includes at least one magnetic pocket configured to accept the at least one magnet. In another embodiment, the at least one magnetic pocket is aligned with the centrally positioned vertical spine. In one embodiment, the at least one magnet is a neodymium magnet. In yet another embodiment, each magnetic pocket of the at least one magnetic pocket includes a cover, wherein the cover is held and secured via a second fastening system. In one embodiment, the centrally positioned vertical spine is constructed of a non-slip fabric to increase friction against the magnetic surface in which the centrally positioned vertical spine is configured to touch. In another embodiment, at least one spine cover is provided, wherein the at least one spine cover is configured to cover at least one portion of the centrally positioned vertical spine, wherein the at least one portion corresponds to the position of the at least one magnet such the backpack is prevented from magnetically attaching to the magnetic surface. In one embodiment, the cover is configured to be removed from the at least one portion such that the backpack may magnetically attach to the magnetic surface. In another embodiment, the left side back panel and the right side back panel include padding, wherein the padding is configured to provide comfort to the user and is configured to position the centrally positioned vertical spine below the left side back panel and the right side back panel. In yet another embodiment, a cell phone pocket is provided, wherein the cell phone pocket is positioned on a front portion of the backpack. In one embodiment, the magnetic surface is a portion of an exercise equipment, such that the backpack is configured to be off a floor surface when the user is using the exercise equipment.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide a backpack with a magnetic back-panel.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words "a" or "an", or other words using the singular or plural number also include the plural or singular number, respectively. Additionally, the words "herein," "above," "below," and words of similar import, when used in this application, shall refer to this application as a whole and not to any particular portions of this application.

As previously mentioned there are many disadvantages of storing a backpack on the floor including but not limited to damage risk, injury and liability risk, and germs and fungal growth. First, keeping a backpack on the floor immediately increases the risk of damage to both the bag and the items inside. This vulnerable location puts the backpack at risk of being stepped on or crushed by an object such as a dumbbell weight. A misplaced dumbbell or a person tripping and falling on the bag could lead to severe damage, such as broken laptops, cell phones, e-readers, and other valuable items often stored in backpacks. Second, positioning a backpack on the floor can lead to significant injury and liability in a public setting. An accidental trip and fall over the backpack can lead to severe injuries making the location of the backpack liable for the injuries. Thus, positioning the backpack away from foot traffic is critical in preventing unnecessary injuries. Third, floors in public places, especially gyms, are also filled with a variety of fungi, bacteria and viruses which can easily stick to the backpack. When the backpack encounters these microorganisms, they are spread to both the user and any area the backpack encounters. Further, even in the safest conditions, though, having a backpack on the ground creates more work for the user. Ideally, a backpack should be in a convenient and safe location, where its contents can be accessed with no physical strain and no risk to its contents or those around it.

Figure 1:
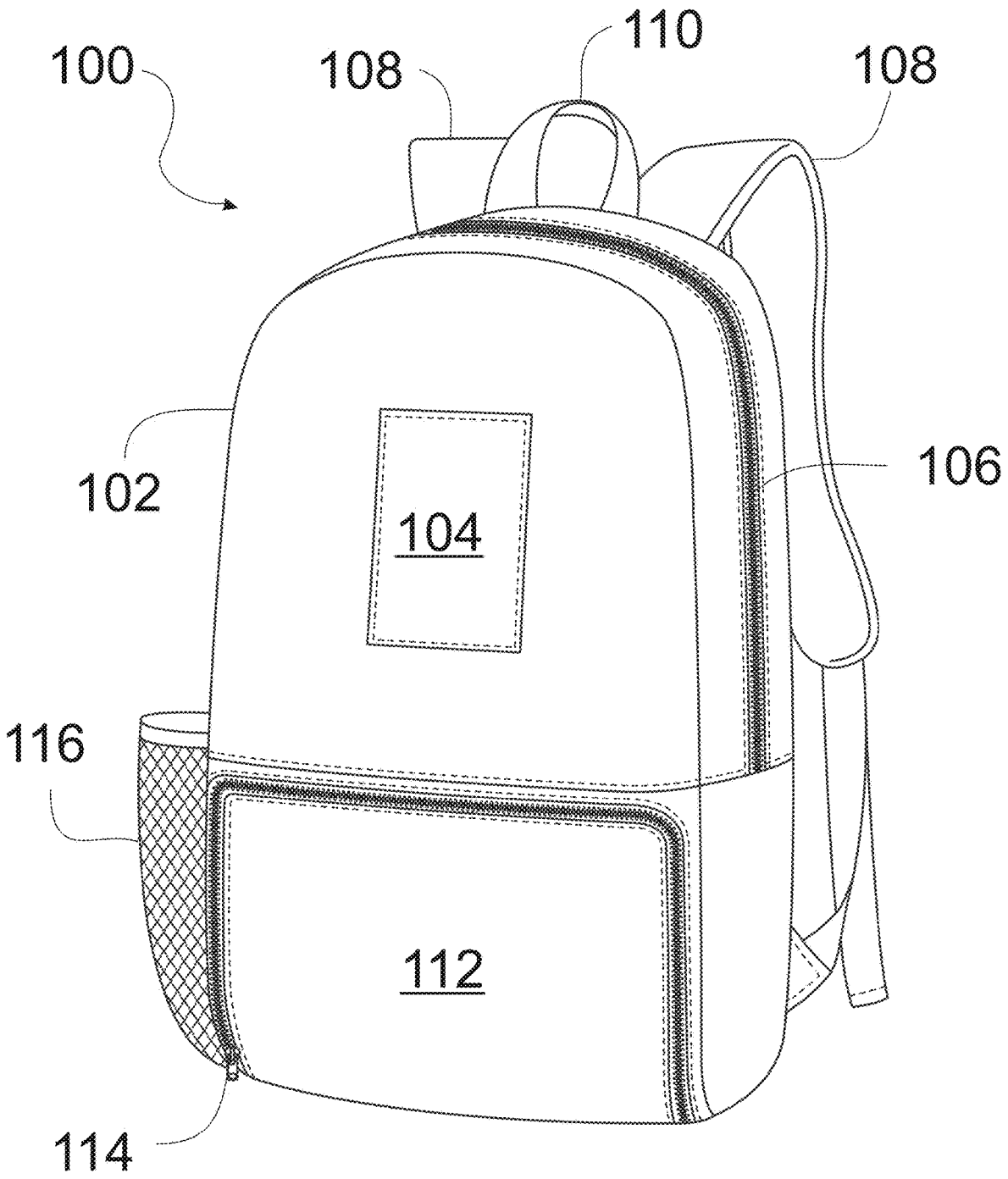
FIG. 1 is a front, perspective view of a backpack with a magnetic back-panel according to an embodiment of the present invention.

FIG. 1 is a front, perspective view of a backpack with a magnetic back-panel 100 according to an embodiment of the present invention. Referring now to FIG. 1, the backpack with magnetic back-panel 100 is illustrated. In one embodiment, the backpack 100 comprises a main compartment 102 and a cellphone pocket 104. In one embodiment, the main compartment is accessible via a first zipper mechanism 106. The backpack includes features found on most backpacks such as a pair of shoulder straps 108, a top handle 110, and at least one drink holder 116. In some embodiments, the at least one drink holder is constructed from a mesh material. In some embodiments, an auxiliary compartment 112 is provided, wherein the auxiliary compartment via a second zipper mechanism 114. It should be understood that although zipper mechanisms are provided, any type of closure system may be provided, such as buttons, hook and loop fasteners, magnetic fasteners, etc.

Advantageously, the cell phone pocket 104 is configured to store a cell phone, such as smartphone, enabling the user to use and access their cellphone in an accessible and convenient location. In one embodiment, the cell phone pocket is constructed from clear PVC having a thickness of 0.02 inches. It should be understood that other materials may be provided, however the clear PVC allows a user to use the device through the PVC. This is beneficial as the use of the cell phone does not require the user to remove the cell phone from the pocket, limiting the potential contamination of germs onto the cellphone and the inconvenience of having to remove the cellphone from the pocket. As one skilled in the art may appreciate, the use and accessibility of the user's cell phone enables the user the ability to text, control music, and record video, such as workout videos to review technique and form for a variety of training exercises.

In some embodiments, the main and auxiliary compartments are constructed from 600 denier polyester with a urethane spray coat. It should be understood that other materials may be used without departing from the spirit of the invention, including but not limited to nylon, cotton, canvas, polyester, and polypropylene. It should also be noted, that although two compartments (main and auxiliary) are illustrated, more compartments at various locations may be provided.

Figure 2A:
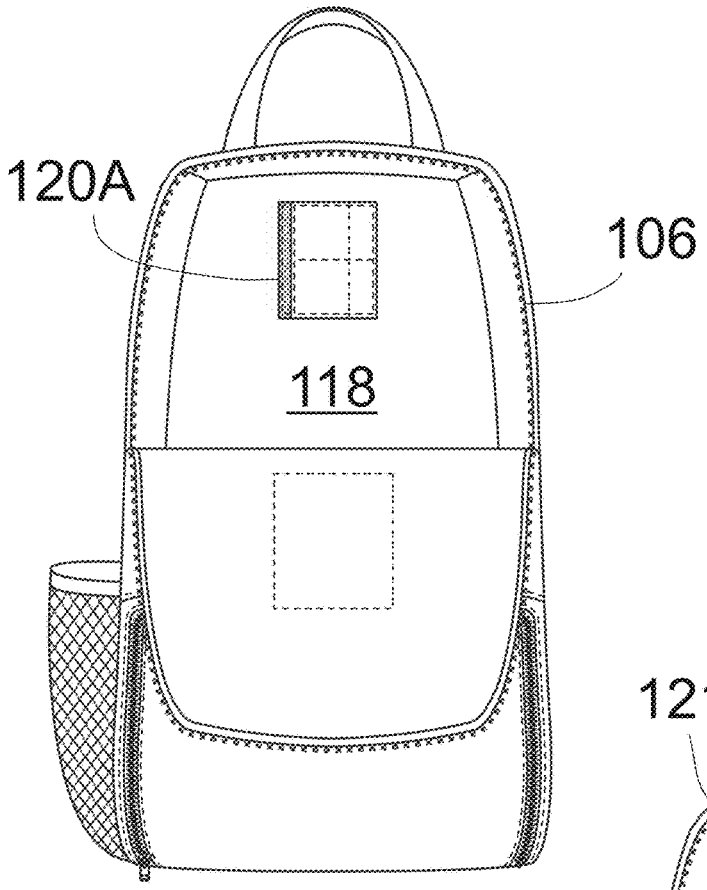
FIG. 2A is a front view of the backpack with a magnetic back-panel showing the main compartment opened exposing a first magnet cover in a locked position according to an embodiment of the present invention.
Figure 2B:
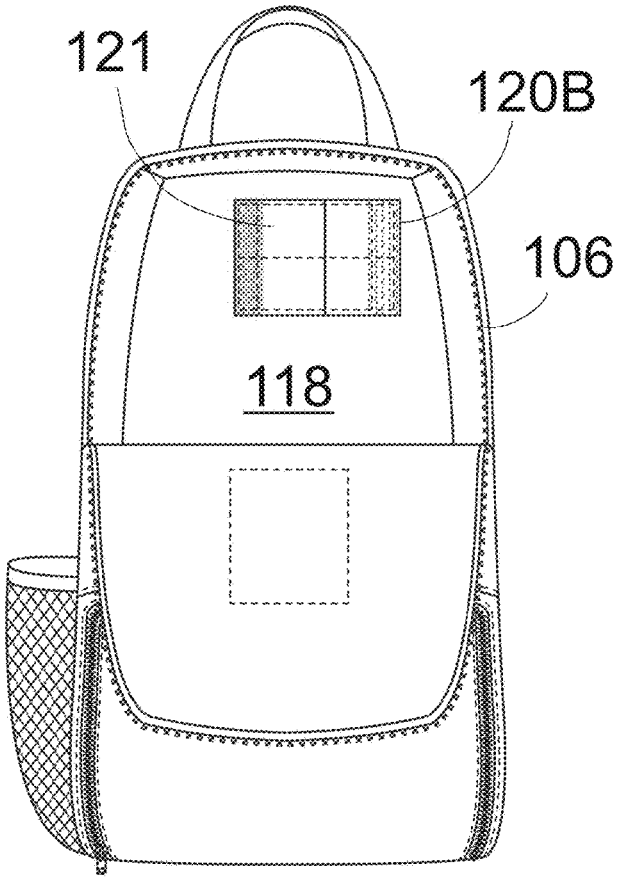
FIG. 2B is a front view of the backpack with a magnetic back-panel showing the main compartment opened exposing the first magnet cover in an unlocked position according to an embodiment of the present invention.

FIGS. 2A-B are front views of the backpack with a magnetic back-panel showing the main compartment opened exposing a first magnet cover in a locked position and unlocked position respectively. Referring now to FIG. 2A, the main compartment is open via the first zipper mechanism 106 exposing the inner storage volume and a front upper portion 118 of the back-panel of the main compartment. In the front upper portion of the back-panel, the first magnet cover 120A is shown in a locked position. Referring now to FIG. 2B, the main compartment is open via the first zipper mechanism 106 exposing the inner storage volume and the front portion 118 of the back-panel of the main compartment. In the front upper portion of the back-panel, the first magnet cover 120B is shown in an unlocked position, wherein the first magnet cover is configured to cover at least one magnet pocket 121 configured to accept at least one magnet (not shown). In some embodiments, the at least one magnet pocket includes two magnet pockets configured to accept two magnets. In some embodiments, the magnet cover is held and secured via a fastening system, such as a hook and loop fastener. Basically, a user may unlock the first magnet cover to install one or more magnets for use. The number of magnets used is non-limiting. In alternative embodiments, the magnetics are permanently installed during manufacturing without the ability to access the at least one magnet pocket.

Figure 3A:
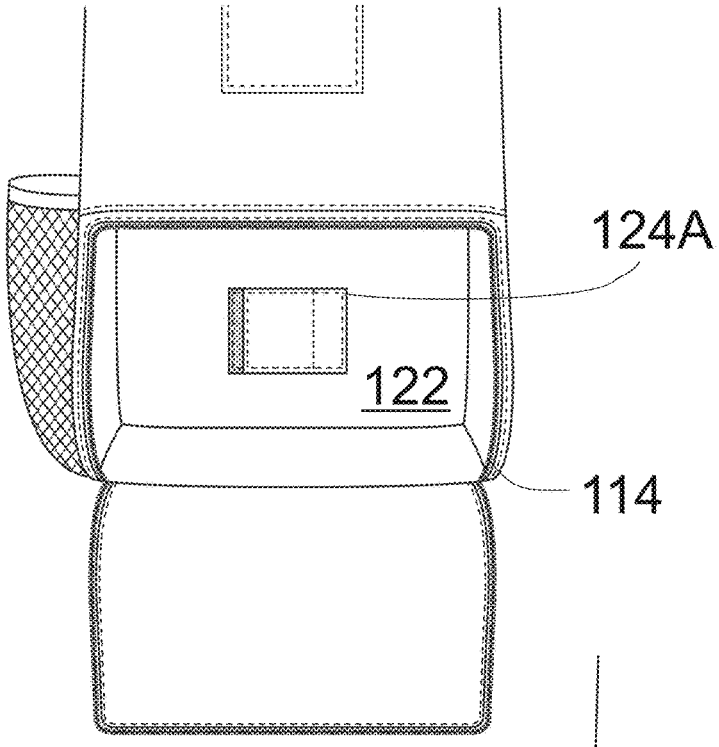
FIG. 3A is a front view of the backpack with a magnetic back-panel showing an auxiliary compartment opened exposing a second magnet cover in a locked position according to an embodiment of the present invention.
Figure 3B:
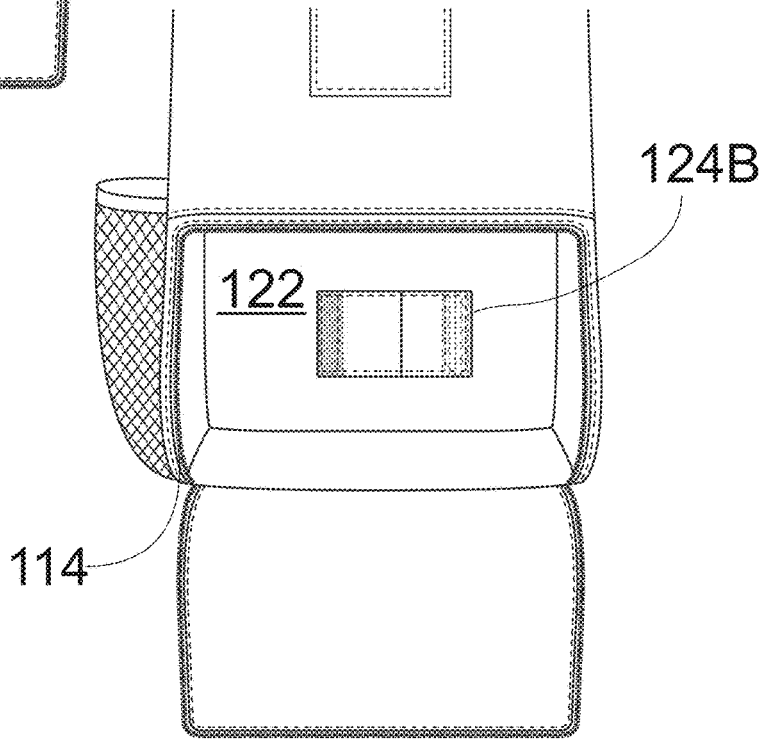
FIG. 3B is a front view of the backpack with a magnetic back-panel showing the auxiliary compartment opened exposing the second magnet cover in an unlocked position according to an embodiment of the present invention.

FIGS. 3A-B are front views of the backpack with a magnetic back-panel showing an auxiliary compartment opened exposing a second magnet cover in a locked position and unlocked position respectively. Referring now to FIG. 3A, the auxiliary compartment is open via the second zipper mechanism 114 exposing the inner storage volume and a front lower portion 122 of the back-panel of the auxiliary compartment. In a rear portion of the inner storage, the second magnet cover 124A is shown in a locked position. Referring now to FIG. 2B, the auxiliary compartment is open via the second zipper mechanism 114 exposing the inner storage volume and the front lower portion 122 of the back-panel of the auxiliary compartment. In the rear lower portion of the back-panel, the second magnet cover 124B is shown in an unlocked position, wherein the second magnet cover is configured to cover at least one magnet pocket 125 configured to accept at least one magnet (not shown). In some embodiments, the at least one magnet pocket includes two magnet pockets configured to accept two magnets. In some embodiments, the magnet cover is held and secured via a fastening system, such as a hook and loop fastener. In alternative embodiments, the magnetics may be permanently installed during manufacturing.

Figure 4A:
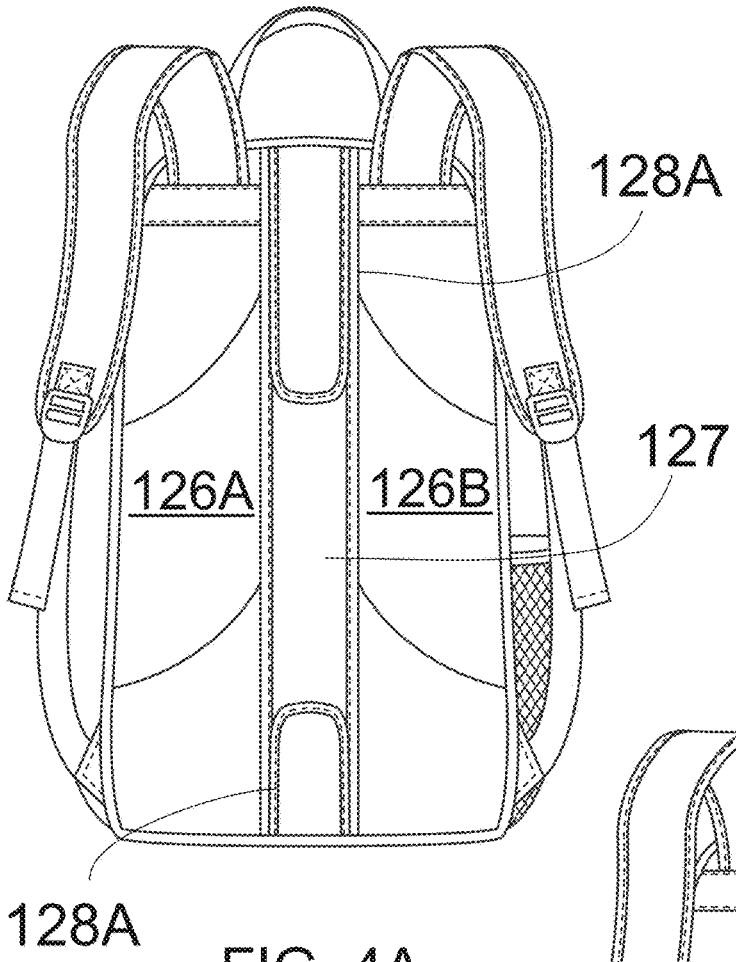
FIG. 4A is a rear view of the backpack with the magnetic back-panel in a non-magnetic use position according to an embodiment of the present invention.
Figure 4B:
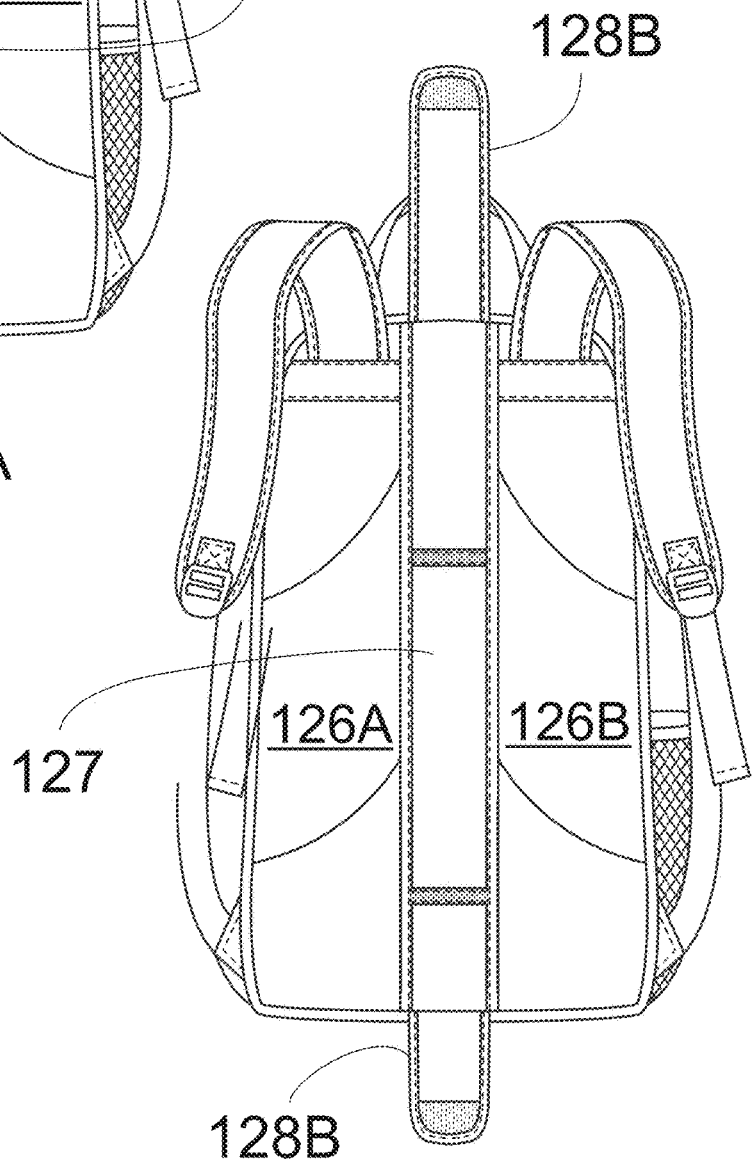
FIG. 4B is a rear view of the backpack with the magnetic back-panel in a magnetic use position according to an embodiment of the present invention.

FIGS. 4A-B are rear views of the backpack with the magnetic back-panel in a non-magnetic use position and magnetic use position respectively. Referring to FIG. 4A, the magnetic back-panel is in a non-magnetic use position. The non-magnetic use position is defined by the magnetic spine cover in a closed position 128A. When the magnetic spine cover is in a closed position, the magnets discussed above are covered by the back-panel, limiting the magnetic force of the magnets positioned in the back-panel of the backpack. Specifically, the magnets are positioned in the vertical spine 127 of the back-panel, which is correlated to the upper and lower portion of the back-panel as previously discussed above, i.e. the magnet pockets with the one or more magnets are directly behind the spine embedded in the back-panel as seen in FIGS. 2A-3B. In FIG. 4A, the spine is covered via the spine cover, thus this position is best for carrying the backpack or when the magnetic force is not needed.

Referring to FIG. 4B, the magnetic back-panel is in a magnetic use position. The magnetic use position is defined by the magnetic spine cover in an open position 128B. When the magnetic spine cover is in an open position, the magnets are not covered by the spine cover, such that the magnetic force in the back-panel of the backpack is ready for use. These "magnetic areas" on in the back-panel (along the vertical spine 127) of the backpack correlate to the magnets in the magnet pockets discussed above. In one embodiment, the vertical spine 127 runs centrally along the entire height of the rear portion of the backpack, separating the rear portion of the back panel into a left side back panel 126A and a right side back panel 126B. In another embodiment, the vertical spine spans only a portion of the height of the rear portion of the backpack. In yet another embodiment, the vertical spine is provided on one or more central locations at various heights along the rear portion of the backpack. In one embodiment, the central vertical spine 127 has a width of two inches and is constructed of a non-slip fabric, to increase friction against the magnetic structure in which the spine is configured to touch during use. In some embodiments, the left side back panel and the right side back panel include padding for comfort, which also is configured to position the spine below the left and right sides of the back panel. This ensures that when the spine cover is in place, it is not extruded from the back-panel causing discomfort when the backpack is carried by a user. It should be understood that the construction of the vertical spine and back-panel may vary. Further, any type of fastener system may be provided to secure the spine cover in a closed position, however, in one embodiment, a hook and loop fastener system is provided. Exemplary uses of the backpack will be discussed in further details below.

Figure 5A:
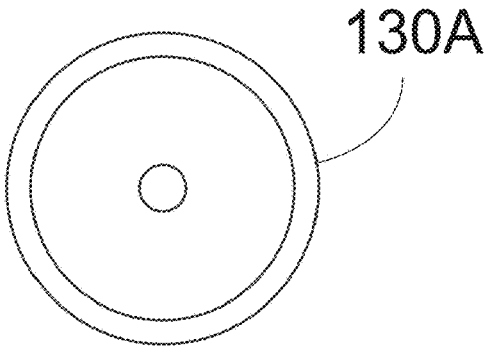
FIG. 5A is a front view of a magnet for use with the backpack with the magnetic back-panel according to an embodiment of the present invention.
Figure 5B:
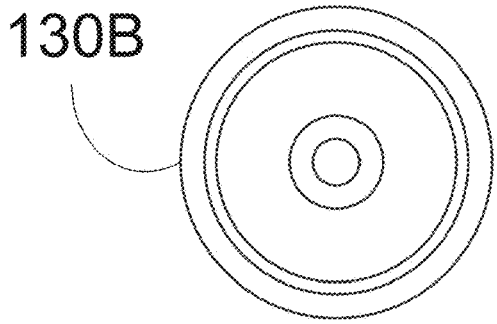
FIG. 5B is a rear view of a magnet for use with the backpack with the magnetic back-panel according to an embodiment of the present invention.

FIGS. 5A-B are various views of a magnet 130 for use with the backpack according to an embodiment of the present invention. Referring now to FIGS. 5A-B, the front and rear view of the magnet is shown 130A and 130B respectively. The rear portion of the magnet (103B) is the side that should face the rear of the backpack during use. In one embodiment, the magnet is axially magnetized. In some embodiments, the magnet is a neodymium magnet. As previously mentioned, a number of these magnets are used, preferably at least four. It should be understood that although circular magnets are illustrated, the magnets may be provided in any shape. Further, the number of selected magnets should be strong enough to hold the backpack, and storage items, in position during use. This will be discussed in further detail below.

Figure 6:
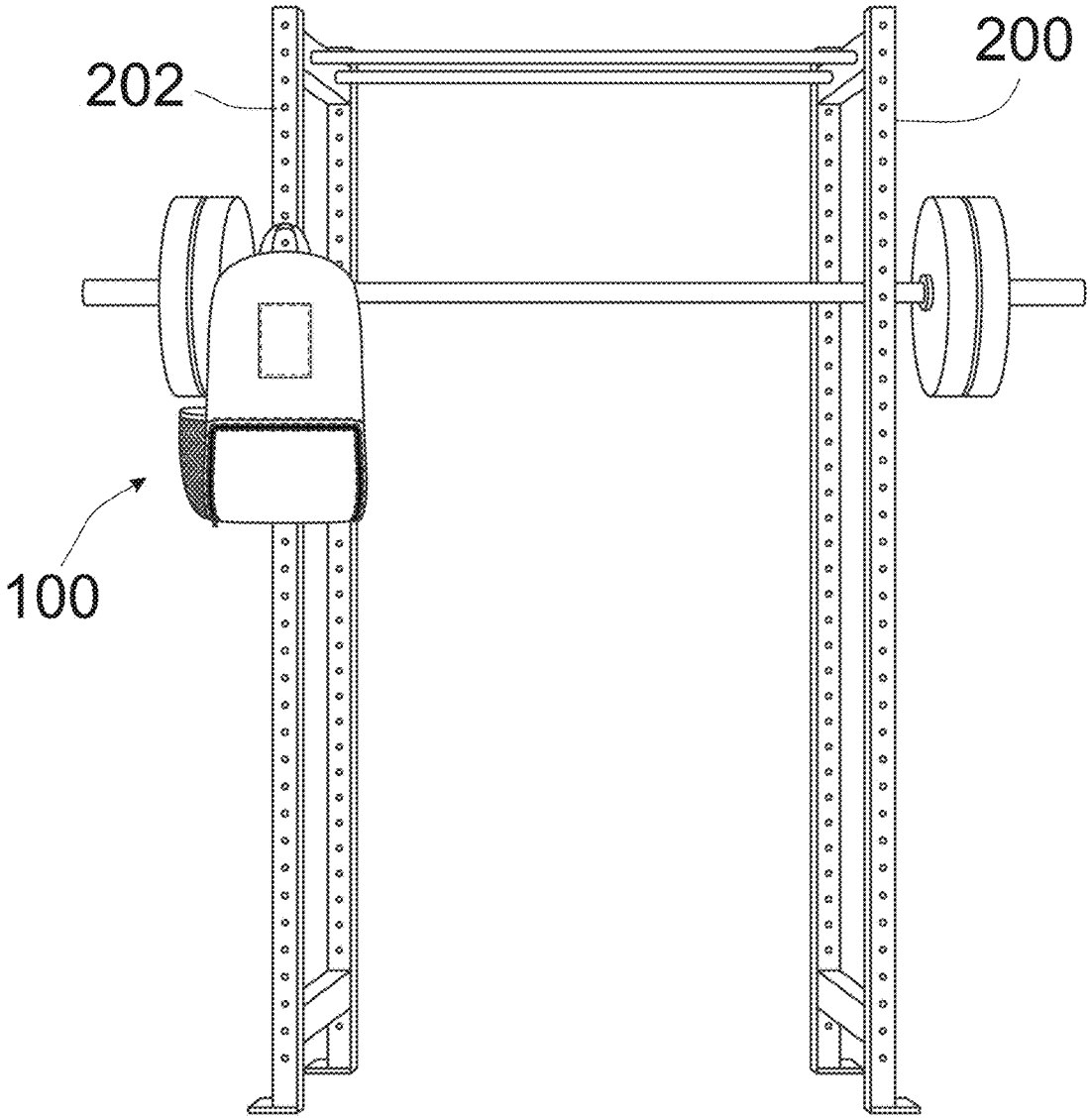
FIG. 6 shows an example of the backpack of the present invention in use according to an embodiment of the present invention.

FIG. 6 shows an example of the backpack 100 of the present invention in use with exercise equipment according to an embodiment of the present invention. Referring to FIG. 6, the backpack 100 is shown in use with a squat rack 200. The backpack 100 is in magnetic connection with a steel tube 202 of the squat rack 200. More specifically, the magnetic areas in back-panel on the rear portion along the spine of the backpack are magnetically connected to the steel tube 202 via the rear side of the number of magnets. In this position, the spine cover is in the open position.

Figure 7:
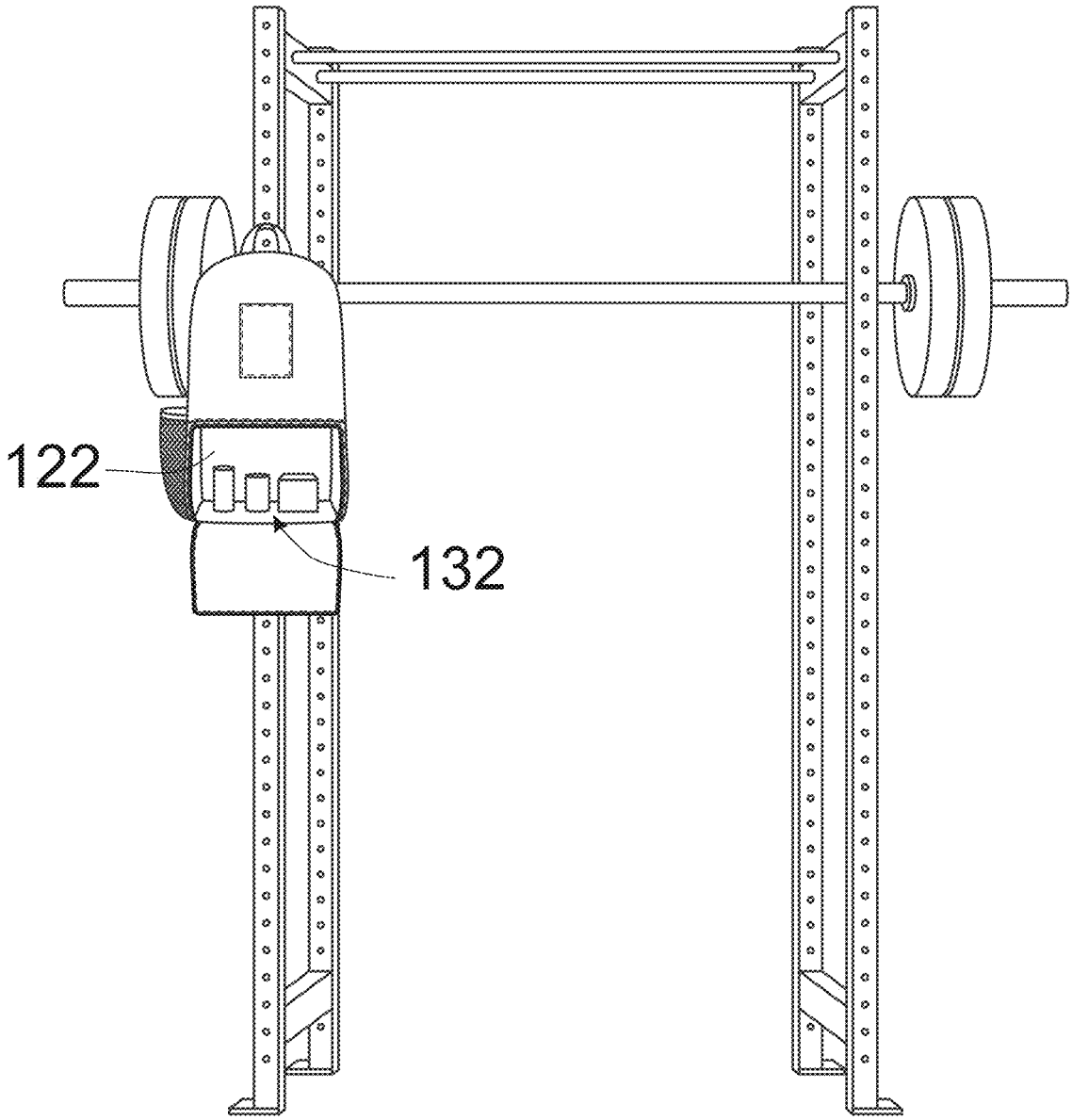
FIG. 7 shows an example of the backpack of the present invention in use showing the auxiliary compartment opened according to an embodiment of the present invention

Referring now to FIG. 7, when the backpack is in use, the auxiliary compartment's inner storage volume 122 may be accessed, giving a user the ability to conveniently access any items 132 stored in the inner storage volume 122.

Figure 8:
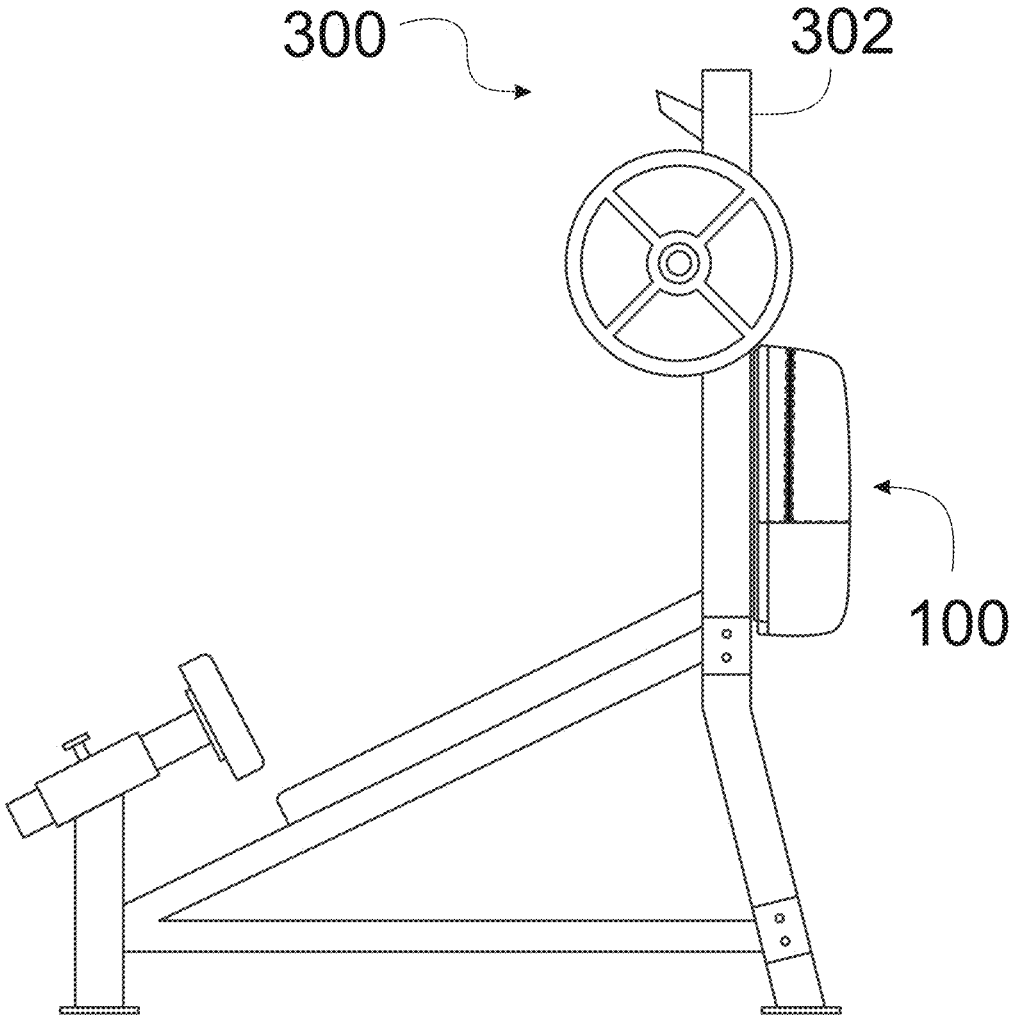
FIG. 8 shows an example of the backpack of the present invention in use according to an embodiment of the present invention.

Similarly, referring now to FIG. 8, the backpack 100 is in use with an additional exercise equipment device, an incline bench press 300. In this example, the backpack 100 is magnetically attached to a portion, such as a steel tube 302, of the incline bench press 300.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternative embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A backpack comprising:

at least one storage compartment having an inner storage volume, wherein the at least one storage compartment is accessible via a first fastening system;

a pair of shoulder straps configured to enable a user to carry the backpack;

a back-panel including a rear portion having a centrally positioned vertical spline; and, at least one magnet positioned in the back-panel, the at least one magnet aligned with the centrally positioned spine, such that the backpack may magnetically attach to a magnetic surface.

2. The backpack of claim 1, wherein the back-panel further includes a front portion opposite the rear portion, the centrally positioned vertical spine splitting the rear portion to define a left side rear back-panel and a right-side rear back-panel.

3. The backpack of claim 2, wherein the front portion of the back-panel includes at least one magnetic pocket configured to accept the at least one magnet.

4. The backpack of claim 3, wherein the at least one magnetic pocket is aligned with the centrally positioned vertical spine.

5. The backpack of claim 3, wherein the at least one magnet is a neodymium magnet.

6. The backpack of claim 3, wherein each magnetic pocket of the at least one magnetic pocket includes a cover, wherein the cover is held and secured via a second fastening system.

7. The backpack of claim 3, the centrally positioned vertical spine is constructed of a non-slip fabric to increase friction against the magnetic surface in which the centrally positioned vertical spine is configured to touch.

8. The backpack of claim 7, further comprising at least one spine cover, wherein the at least one spine cover is configured to cover at least one portion of the centrally positioned vertical spine, wherein the at least one portion corresponds to the position of the at least one magnet such the backpack is prevented from magnetically attaching to the magnetic surface.

9. The backpack of claim 8, wherein the cover is configured to be removed from the at least one portion such that the backpack may magnetically attach to the magnetic surface.

10. The backpack of claim 2, wherein the left side back panel and the right side back panel include padding, wherein the padding is configured to provide comfort to the user and is configured to position the centrally positioned vertical spine below the left side back panel and the right side back panel.

11. The backpack of claim 1, further comprising a cell phone pocket, wherein the cell phone pocket is positioned on a front portion of the backpack.

12. The backpack of claim 1, wherein the magnetic surface is a portion of an exercise equipment, such that the backpack is configured to be off a floor surface when the user is using the exercise equipment.

* * * * *